US007404622B2

(12) United States Patent
Morris et al.

(10) Patent No.: US 7,404,622 B2
(45) Date of Patent: Jul. 29, 2008

(54) INK REPELLENT COATING ON CHARGE DEVICE TO IMPROVE PRINTER RUNABILITY AND PRINTHEAD LIFE

(75) Inventors: Brian G. Morris, Dayton, OH (US); James A. Katerberg, Kettering, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/561,452

(22) Filed: Nov. 20, 2006

(65) Prior Publication Data

US 2007/0070123 A1 Mar. 29, 2007

Related U.S. Application Data

(62) Division of application No. 10/839,409, filed on May 5, 2004, now Pat. No. 7,156,488.

(51) Int. Cl.
*B41J 2/14* (2006.01)
*B41J 2/07* (2006.01)

(52) U.S. Cl. ..... 347/47; 347/74

(58) Field of Classification Search ..... 347/45, 347/47, 74, 75

See application file for complete search history.

(56) References Cited

U.S. PATENT DOCUMENTS 4,031,561 A 6/1977 Paranjpe
4,591,870 A 5/1986 Braun et al.
4,591,873 A 5/1986 McCann et al.
4,623,873 A 11/1986 Mehrgardt
4,626,869 A 12/1986 Piatt
4,928,114 A 5/1990 Fagerquist et al.
5,512,117 A 4/1996 Morris
6,325,490 B1 12/2001 Yang et al.
6,345,880 B1 2/2002 DeBoer et al.
6,478,413 B1 11/2002 Motegi et al.
6,543,885 B2 4/2003 Bahl et al.

FOREIGN PATENT DOCUMENTS

EP 0 613 778 2/1994

OTHER PUBLICATIONS

"Charge Plate Passivation Process", by R.M. Peekema, IBM Technical Disclosure Bulletin, IBM Corp., New York, vol. 20, No. 11B, Apr. 1978, p. 4923, XP 002050869, Paragraphs 0001-0003.

*Primary Examiner*—An H Do
(74) *Attorney, Agent, or Firm*—Buskop Law Group, PC

(57) ABSTRACT

An ink jet printhead includes a drop generator having an attached orifice structure forming a jet array adapted to use ink jet fluids with a charge device disposed opposite the jet array forming a gap. The charge device includes a dimensionally stable, non-porous substrate layer having a high load to deflection ratio, one or more electrically conducting leads bonded to the substrate layer, an insulating protective layer disposed over the electrically conducting lead, and a non-wetting polymer coating compatible with the ink jet fluids disposed on the insulating protective layer. The coating reduces the capillary forces that hold liquid in the gap between the orifice structure and the charge device

10 Claims, 2 Drawing Sheets

INK REPELLENT COATING ON CHARGE DEVICE TO IMPROVE PRINTER RUNABILITY AND PRINTHEAD LIFE

CROSS REFERENCE TO RELATED APPLICATIONS

This is a divisional application of application Ser. No. 10/839,409, filed May 5, 2004 now U.S. Pat. No. 7,156,488.

FIELD OF THE INVENTION

The present embodiments relate to continuous inkjet printers which employ charge devices in association with a drop generator and orifice structure.

BACKGROUND OF THE INVENTION

Ink jet printers are sensitive to the presence of debris or dried ink residues on various components. Various procedures have been developed for operation of the printhead which remove such contaminants from these sensitive components. When printheads have reduced orifice sizes, desirable for higher quality color printing, the operations for removing contaminants from sensitive components can leave ink in the space between the charge device and the orifice structure. Failure to remove ink from this space can result in electrical shorting conditions between the leads on the charge device and other leads or components in the printhead. These types of shorting conditions often result in printhead errors and premature printhead failure.

A need exists for a way to facilitate the removal of ink from the space or gap between the charge device and orifice structure even when using orifices of reduced size.

The present embodiments described herein were designed to meet this need.

SUMMARY OF THE INVENTION

An ink jet printhead includes a drop generator with an attached orifice structure forming a jet array adapted to use ink jet fluids with a charge device disposed opposite the jet array forming a gap. The charge device has a dimensionally stable, non-porous substrate layer with a high load to deflection ratio, one or more electrically conducting leads bonded to the substrate layer, an insulating protective layer disposed over the electrically conducting lead, and a coating of a non-wetting polymer compatible with the ink jet fluids disposed on the insulating protective layer. The coating reduces the capillary forces that hold liquid in the gap between the orifice structure and the charge device

BRIEF DESCRIPTION OF THE DRAWINGS

In the detailed description of the preferred embodiments presented below, reference is made to the accompanying drawings, in which.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

The improved printhead has a charge device with a coating that results in low surface energy thereby minimizing the chance for ink to be left in a space or gap between the orifice structure and the charge device after the startup of the printhead.

The improved printhead has a coating on the charge device that enables the printhead to have a higher print quality, and an improved and more reliable start up without shorting the leads of the charge device.

This improved printhead advances the longevity of printhead operation, and improves the versatility of the printhead by increasing the printhead's ability to run different viscosity inks and different types of inks.

This improved printhead allows the printhead to have smaller orifice sizes on the orifice structure by reducing the capillary tension in the space or gap between the charge device and the orifice structure enabling the printhead to be used for higher resolution process color printing.

An embodiment of the printhead includes a drop generator with an attached orifice structure forming a jet array adapted to use ink jet fluids with a charge device disposed opposite the jet array forming a gap. The charge device has a dimensionally stable, non-porous substrate layer having a high load to deflection ratio; at least one electrically conducting lead bonded to the substrate layer; an insulating protective layer disposed over the electrically conducting lead; a coating of a non-wetting polymer compatible with the ink jet fluids disposed on the insulating protective layer to reduce the capillary forces that hold liquid in the gap between the orifice structure and the charge device.

A second embodiment of an ink jet printhead includes a drop generator with an attached orifice structure forming a jet array adapted to use ink jet fluids with a charge device disposed opposite the jet array forming a gap, wherein the charge device is made from a dimensionally stable, load deflecting, non-porous substrate layer having a high load to deflection ratio; at least one electrically conducting lead bonded to the substrate; and a coating of an electrically insulating partially wettable polymer compatible with the ink jet fluids disposed over the electrically conducting lead to partially reduce the capillary forces that hold liquid in the gap between the orifice structure and charge device. The printhead is usable in an ink jet print station, such as a Kodak Versamark DT92 print station available from Kodak Versamark of Dayton, Ohio.

Figure 1:
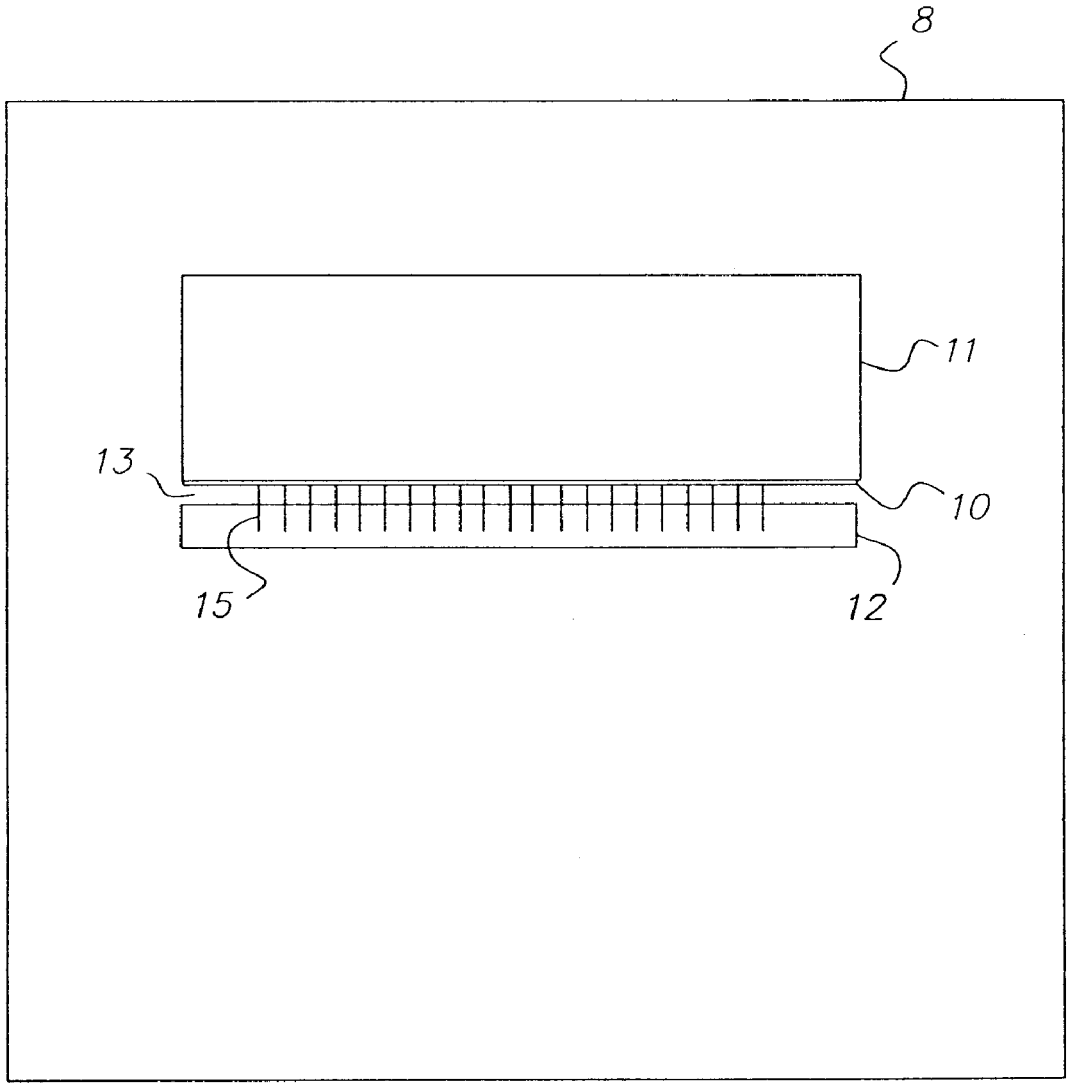
FIG. 1 depicts a partial cross section of a printhead showing the charge device.

With reference now to the Figures, FIG. 1 depicts an ink jet printhead 8 having an orifice structure 10, a drop generator 11 and a charge device 12 disposed opposite the orifice structure forming a gap 13. In this printhead, fluid flows into the drop generator, through the orifice structure making a jet array 15 that creates ink drops. The charge device 12 causes some of the ink drops to go to a print media and some of the ink drops to go to a catcher that then communicates the ink drops back to the source of the fluid or to another container.

Typically the jet array 15 is formed from between 100 orifices and 5000 orifices in an orifice structure. In another embodiment, the jet array can be formed from an orifice structure that has 300 orifices per inch with each jet having a diameter of about seven microns to about forty microns.

Figure 2:
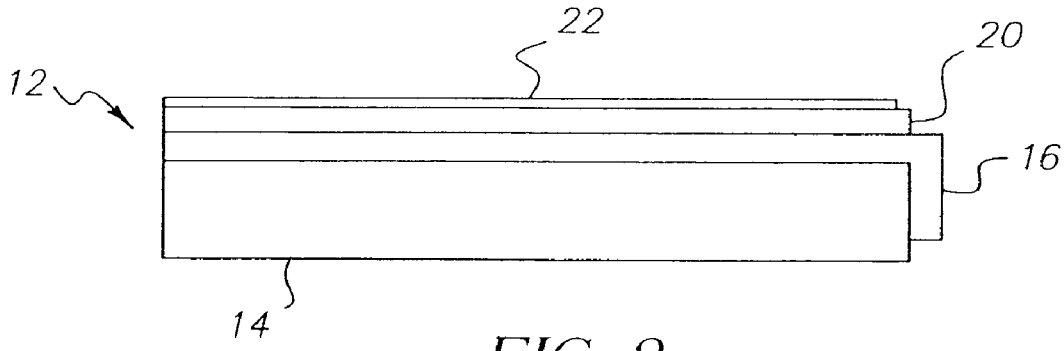
FIG. 2 depicts a detailed view of the charge device.

FIG. 2 depicts an embodiment of the improved charge device 12. The charge device 12 has a substrate layer 14 that can be a metal, like stainless steel, a polymer, such as polyethylene, a ceramic, such as alumina, or a glass, a composite, a laminate, an alloy thereof or other combinations of these materials.

At least one electrically conducting lead 16 is bonded to substrate layer 14. The bonding can occur using physical vapor deposition, screen printing, chemical vapor deposition, sputtering, evaporation or another similar process. A screen printing and firing sequence can be used to bond the electrically conducting lead to the substrate layer. Electroplating, electrolysis, or other electrolytic processes could also be used to deposit the various layers of the charge device.

The electrically conducting lead can be made of between 100 metal leads and 5000 metal leads. The electrically conducting leads are connected to an energy source that is not shown in the figures, but is conventional and provides the needed voltage to the charge device. Voltage, typically between 75 volts and 200 volts, is used for the charge device.

If the electrically conducting leads are metal, the leads can be made from electroplated nickel The metal lead can be bonded to the substrate layer 14 with a polymer, such as an epoxy called EPO-TEK 353ND available from Epoxy Technology of Billerica, MA.

Alternatively, the electrically conducting leads can be bonded to the substrate layer with a polymer compatible with the ink jet fluids. The polymer could also be a thermoplastic adhesive, a polyimide adhesive, a polyurethane adhesive, a silicone adhesive, or combinations of these with or without the epoxy. In a preferred embodiment, the polymer is an electrically insulating polymer.

An insulating protective layer 20 is disposed over the electrically conducting lead 16 on the substrate 14 in the embodiment of FIG. 2. Typically, the material of the insulating layer 20 is EPO-TEK 353ND available from Epoxy Technology of Billerica, Mass. Other versions of the 353 EPO-TEK can also be used.

Disposed on the insulating protective layer 20 is a coating of a non-wetting polymer 22 that is compatible with the ink jet fluids that enter the gap between the orifice structure and the jet array.

The non-wetting polymer can be a fluorocarbon based polymer, a hydrocarbon based polymer or silicone based polymers or another similar polymer that further reduces the capillary forces that hold liquid in the gap between the orifice structure and the charge device. The fluorocarbon based polymer can be Teflon™ from EI Dupont of Wilmington, Del., or it can be EGC-1700 available from 3M of St. Paul, Minn.

The ink jet fluids with that the non-wetting polymer must be compatible can be ink jet cleaning fluids, ink jet ink, or ink jet replenishment fluids. The fluids are typically a Kodak Versamark FF1035 for the ink jet cleaning fluid, a Kodak Versamark FD 1007 or 1036 black ink jet ink, or a Kodak Versamark FR 1014 replenishment ink. The inks can be water based inks, solvent based inks, dye based inks, pigment based inks or oil based inks.

The non-wetting polymer coating reduces the capillary forces that hold liquid in the gap between the orifice structure and the charge device facilitating removal the liquid from the orifice structure and the charge device.

Figure 3:
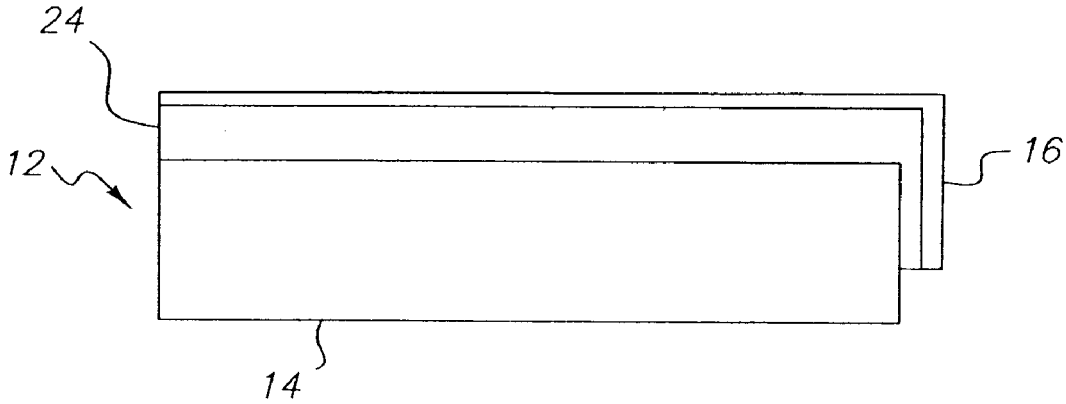
FIG. 3 depicts a detailed view of different construction of the charge device.
Figure 4:
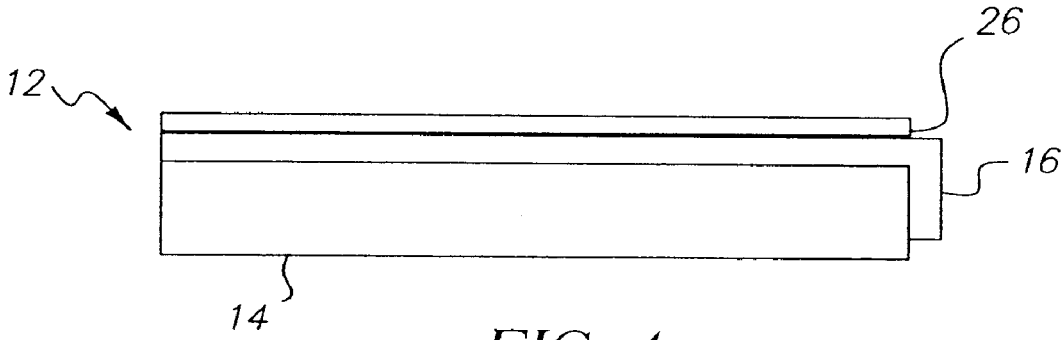
FIG. 4 depicts a second embodiment of the charge device.

FIG. 3 depicts another embodiment, wherein the electrically conducting lead 16 is bonded to the substrate 14 with a polymer 24. A preferred polymer used to adhesively bond the electrically conducting lead to the substrate. The epoxy from Epoxy Technology product number: EPO-TEK-353ND can be used, as well as other polymer described above, including the thermoplastic adhesive, the polyimide adhesive, the polyurethane adhesive or the silicone adhesive and combinations of these, with and without the epoxy. FIG. 4 depicts another embodiment of the charge device for the ink jet printhead wherein the charge device 12 has a substrate layer 14 at least one electrically conducting lead 16 bonded to substrate 14 and a coating of electrically insulating partially wettable polymer 26 compatible with the ink jet fluids of the printhead. This coating is disposed at least partially over the electrically conducting lead, and is adjacent the gap 13 to partially reduce the capillary forces that hold liquid in the gap. See FIGS. 1 and 4.

The polymer 26 can be a mixture of epoxy with a fluro-surfactant, which at least partially reduces the capillary forces that enable liquid in the gap between the orifice structure and charge device during startup. A preferred fluro-surfactant is Novec™ FC-4430 from 3M.

Similar to the other embodiments, the conducting lead can be bonded to the charge device with the polymer 24, which is preferably electrically insulating.

In conjunction with any of these embodiments, the capillary forces that hold liquid between the orifice structure and the charge device can be further reduced by additionally applying an anti-wetting coating to the orifice structure. The anti-wetting coating applied to the orifice structure is a non-wetting polymer. The non-wetting polymer can be a fluorocarbon based polymer, or a hydrocarbon based or silicone based polymer. The non-wetting polymer must be compatible with the ink jet fluids, such as ink jet ink, ink jet replenishment fluids, or ink jet cleaning fluids.

The embodiments have been described in detail with particular reference to certain preferred embodiments thereof, but it will be understood that variations and modifications can be effected within the scope of the embodiments, especially to those skilled in the art.

PARTS LIST

8. ink jet printhead
10. orifice structure
11. drop generator
12. charge device
13. gap
14. substrate layer
15 jet array
16. electrically conducting lead
20. insulating protective layer
22. non-wetting polymer coating
24. polymer
26. insulating protective layer of partially wettable polymer

The invention claimed is:

1. An ink jet printhead comprising a drop generator with attached orifice structure forming a jet array adapted to use ink jet fluids, and a charge device disposed opposite the jet array forming a gap between the orifice structure and the charge device into which liquid can enter, wherein the charge device comprises:

a. a dimensionally stable, load deflecting, non porous substrate layer comprising a high load to deflection ratio;

b. at least one electrically conducting lead bonded to the substrate layer; and c. a coating of a electrically insulating, partially wettable polymer compatible with the ink jet fluids is disposed over the electrically conducting lead, wherein the coating is adjacent the gap to reduce partially capillary forces that hold liquid in the gap.

2. The ink jet printhead of claim 1, wherein the coating of electrically insulating partially wettable polymer is a mixture of epoxy and a fluro-surfactant.

3. The printhead of claim 1, wherein the at least one electrically conducting lead is bonded to the charge device with a polymer.

4. The printhead of claim 3, wherein the polymer is an epoxy, thermoplastic adhesive, a polyimide adhesive, a polyurethane adhesive a silicone adhesive or combinations thereof.

5. The ink jet printhead of claim 4, wherein the polymer is an electrically insulating polymer.

6. The ink jet printhead of claim 1 wherein a coating of a non-wetting polymer compatible with the ink jet fluids is disposed on the orifice structure opposite the charge device.

7. The ink jet printhead of claim 6, wherein the non-wetting polymer comprises a fluorocarbon based polymer, a hydrocarbon based polymer, or a silicone based polymer, and wherein the coating further reduces the capillary forces that hold liquid in the gap between the orifice structure and the charge device.

8. The ink jet printhead of claim 1, wherein the substrate layer is a member of the group consisting of a metal, a polymer, a ceramic, a glass, a composite, a laminate, alloys thereof, and combinations thereof.

9. The ink jet printhead of claim 1, wherein the conductive lead is a metal lead.

10. The ink jet printhead of claim 1, wherein the ink jet fluids comprise: an ink jet cleaning fluid, an ink jet ink, and an ink jet replenishment fluid.

* * * * *